US005124716A

United States Patent [19]

Roy et al.

[11] Patent Number: 5,124,716

[45] Date of Patent: Jun. 23, 1992

[54] METHOD AND APPARATUS FOR PRINTING WITH INK DROPS OF VARYING SIZES USING A DROP-ON-DEMAND INK JET PRINT HEAD

[75] Inventors: Joy Roy, Beaverton; Susan C. Schoening, Portland, both of Oreg.

[73] Assignee: Tektronix, Inc., Beaverton, Oreg.

[21] Appl. No.: 692,957

[22] Filed: Apr. 26, 1991

Related U.S. Application Data

[63] Continuation of Ser. No. 461,860, Jan. 8, 1990, abandoned.

[51] Int. Cl.[5] ..... B41J 2/045

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 3,846,800 | 11/1974 | Chen . | |
| 3,946,398 | 3/1976 | Kyser et al. | 346/140 X |
| 4,393,384 | 7/1983 | Kyser | 346/140 X |
| 4,403,223 | 9/1983 | Tsuzuki et al. | 346/140 X |
| 4,491,851 | 1/1985 | Mizuno et al. | 346/140 X |
| 4,499,479 | 2/1985 | Lee et al. | 346/140 |
| 4,503,444 | 3/1985 | Tacklind | 346/140 |
| 4,513,299 | 4/1985 | Lee et al. | 346/140 |
| 4,560,997 | 12/1985 | Sato et al. . | |
| 4,561,025 | 12/1985 | Tsuzuki et al. | 346/140 X |
| 4,563,689 | 1/1986 | Murakami | 346/140 X |
| 4,630,076 | 12/1986 | Yoshimura . | |
| 4,635,078 | 1/1987 | Sakurada et al. . | |
| 4,639,735 | 1/1987 | Yamamoto et al. | 346/140 X |
| 4,680,645 | 7/1987 | Dispoto et al. . | |
| 4,682,216 | 7/1987 | Sasaki et al. . | |
| 4,686,539 | 8/1987 | Schmidle et al. | 346/140 X |
| 4,695,846 | 9/1987 | Suzuki . | |
| 4,713,746 | 12/1987 | Watanabe et al. . | |
| 4,714,935 | 12/1987 | Yamamoto | 346/140 |
| 4,714,964 | 12/1987 | Sasaki . | |
| 4,727,436 | 2/1988 | Kawamura et al. . | |
| 4,745,420 | 5/1988 | Gersteinmaier | 346/140 |
| 4,746,935 | 5/1988 | Allen . | |
| 4,772,911 | 9/1988 | Sasaki . | |

OTHER PUBLICATIONS

"High Frequency Recording With Electrostatically Deflected Ink Jets" from review of *Scientific Instruments*, vol. 36, No. 2, Feb. 1965 by Richard G. Sweet.

"Electric Control of Fluid Jets in Its Applicatioin to Recording Devices" by C. H. Hertz, *The Review of Scientific Instruments*, vol. 43, No. 3 (pp. 413–416) (1972).

"Full-Color Ink-Jet Printer Using Multilevel Ink" by Takahashi, et al., *SID 1985 Digest* (pp. 329–331).

"Drop-on-Demand Ink Jet Printing at High Print Rates and High Resolution" by F. C. Lee (IBM Research Laboratory 1981).

*Primary Examiner*—Joseph W. Hartary

*Attorney, Agent, or Firm*—John D. Winkelman; Alan K. Aldous

[57] ABSTRACT

A drop-on-demand ink jet has an ink chamber coupled to a source of ink, and an ink drop orifice with an outlet. An acoustic driver produces a pressure wave in the ink and causes the ink to pass outwardly through the ink drop orifice and outlet. The size of the ink drops may be varied, such as by driving the acoustic driver with varying drive signals, preferably comprising individual or combinations of plural bipolar drive pulses. The ink jet printer of the present invention may be used to print with a wide variety of inks, including phase change inks.

16 Claims, 2 Drawing Sheets

METHOD AND APPARATUS FOR PRINTING WITH INK DROPS OF VARYING SIZES USING A DROP-ON-DEMAND INK JET PRINT HEAD

This is a continuation of application Ser. No. 07/461,860 filed Jan. 8, 1990, now abandoned.

BACKGROUND OF THE INVENTION

The present invention relates to printing with a drop-on-demand ink jet print head wherein ink drops of varying sizes are generated. In addition to other applications, the present invention is particularly useful in grey scale or half-tone printing in which ink drop size is selectively varied during printing.

Ink jet printers, and in particular drop-on-demand ink jet printers having print heads with acoustic drivers for ink drop formation are well known in the art. The principle behind an impulse ink jet of this type is the generation of a pressure wave in an ink chamber and subsequent emission of ink droplets from the ink chamber through a nozzle orifice as a result of the pressure wave. A wide variety of acoustic drivers are employed in ink jet print heads of this type. For example, the drivers may consist of a transducer formed by a piezoceramic material bonded to a thin diaphragm. In response to an applied voltage, the piezoelectric ceramic deforms causing the diaphragm to displace ink in the ink chamber and causes a pressure wave and the flow of ink through one or more nozzles. Piezoelectric drivers may be of any suitable shape such as circular, polygonal, cylindrical, annular-cylindrical, etc. In addition, piezoelectric drivers may be operated in various modes of deflection, such as in the bending mode, shear mode, and longitudinal mode. Other types of acoustic drivers for generating pressure waves in ink include heater-bubble source drivers (so called bubble or thermal ink jets) and electromagnet-solenoid drivers. In general, it is desirable in an ink jet print head to employ a geometry that permits multiple nozzles to be positioned in a densely packed array with each nozzle being driven by an associated acoustic driver.

The prior art has also recognized that advantages may arise from printing with ink drops of selectively varying volume. For example, drop volume can be selected to provide optimum spot size to effectively produce high resolution printing. Also, by using only larger drops, a draft-mode print quality can be chosen. Such printers are also useful in applications requiring half-tone images, such as involving the control of color saturation, hue and lightness.

U.S. Pat. No. 4,513,299 of Lee, et al. describes one approach for achieving variations in ink drop size. In this approach, an electromechanical transducer is coupled to an ink chamber and is driven by one or more electrical drive signals of the same polarity which are each separated by a fixed time delay. This time delay is short with respect to the drop-on-demand drop production rate. Each electrical drive signal ejects a predetermined volume of ink with the ejected volumes of ink merging to form a single drop. An increase in the number of electrical drive signals between the formation and ejection of a drop causes an increase in the drop volume. This patent mentions that the various sized drops travel at a constant velocity to the print medium. This patent also recognizes that, because the print head is moving at a constant velocity during printing, any variation in drop velocity would cause displacement of the drops on the print medium from their desired position, and would degrade the print quality. However, inasmuch as all of the energy for drop formation and ejection results from the drive pulse supplied to the transducer, the variation in drop size is somewhat limited, the velocity of individual drops is limited, and some variation in the travel time to paper would tend to occur. In addition, the capacity of the ink jet to produce large ink drops using a large number of successive pulses limits the maximum rate of drop ejection. U.S. Pat. No. 4,491,851 of Mizuno, et al. illustrates another approach in which successive drive pulses are used to generate ink drops of varying sizes.

U.S. Pat. No. 4,561,025 of Tsuzuki describes another printer for printing half-tone images with ink drops or dots of varying sizes. The diameter of each dot is controlled by controlling the energy content of the driving pulse which causes the dot, for example, by varying the amplitude or pulse width of the driving pulse.

U.S. Pat. No. 4,563,689 of Murakimi, et al. discloses still another approach for achieving half-tone printing. In this approach, a preceding pulse is applied to an electromechanical transducer prior to a main pulse. The preceding pulse is described as a voltage pulse that is applied to a piezoelectric transducer in order to oscillate ink in the nozzle. The preceding pulse controls the position of the ink meniscus in the nozzle and thereby the ink drop size. In FIGS. 4 and 8, of this patent, the preceding and main pulses are of the same polarity. In FIGS. 9 and 11, of this patent, these pulses are of opposite polarity. This patent also mentions the control of ink drop size by changing the voltage and/or the pulse duration of the preceding pulse and the time interval between the application of the preceding pulse and the main pulse.

U.S. Pat. No. 4,403,223 of Tsuzuki, et al. describes a drop-on-demand type ink jet printer in which a driving pulse is applied to a piezoelectric transducer to cause the ejection of a drop of ink from a nozzle. The drop size is varied by controlling the energy content of the applied driving pulse for purposes of achieving half-tone printing. The ejected ink drops pass between charging electrodes and are charged by a voltage which is applied as the drops are ejected from the nozzle. This charging voltage varies as a function of the energy content of the driving pulses. In the embodiment of FIG. 10 of this patent, the charged ink drops pass between deflection plates which generate a field oriented transversely to the direction of drop travel for purposes of altering the flight path of the drops. In the FIG. 1 form of the apparatus, the charged drops pass between a pair of plates 40 and a pair of plates 60, with the deflection plates positioned between plates 60 and plates 40. The plates 40 and 60 establish an electric field oriented in the direction of travel of the ink drops for purposes of accelerating the drops.

The Tsuzuki, et al. patent requires relatively complex driving circuits inasmuch as the charging voltage is varied with variations in the driving pulse. In addition, the use of deflection voltages also adds to the complexities of this device.

Although these prior art devices are known, a need exists for an improved ink jet printer which is capable of effectively achieving half-tone or grey scale printing using a range of ink drop sizes and without requiring complex field switching or time delay circuitry.

SUMMARY OF THE INVENTION

A drop-on-demand ink jet is described of the type having an ink chamber coupled to a source of ink, an ink drop forming orifice with an outlet, and in which the ink drop orifice is coupled to the ink chamber. An acoustic driver is used to produce a pressure wave in the ink to cause the ink to pass outwardly through the ink drop orifice and the outlet. The drive signal applied to the acoustic driver is selectively varied to vary the volume of ink in the ink drops produced by the ink jet.

As another aspect of the present invention, at least one bipolar electric pulse, with refill and ejection or eject pulse components of voltages of opposite polarity which are separated by a wait period, may be applied to acoustic drivers of the ink jet printer. The volume of the ink in the ink drops is varied by selectively varying the duration of the wait period, varying the duration or pulse width of the ejection pulse component, varying the amplitude of the ejection pulse component, varying the ratio of the pulse width of the ejection pulse component to the pulse width of the refill pulse component, varying the ratio of the amplitude of the ejection pulse component to the amplitude of the refill pulse component, and by combinations of the above techniques.

In another approach for varying the volume of ink in the ink drops, a plurality of bipolar pulses are used to form the drops, with the number of pulses used to form an individual drop controlling the volume of ink in the drop. Each of these bipolar electric pulses are separated from one another by a time period which is insufficient to permit the breaking off of an ink drop at the orifice outlet until a selected number of the bipolar drive pulses have been applied. In one specific approach, these bipolar electric pulses are separated from one another by a time period of at least about two times the duration of an individual bipolar electric pulse. More specifically, the bipolar electric pulses which are applied to form a single drop may be separated from one another by a time period of from about 40 microseconds to about 100 microseconds.

The drop-on-demand ink jet printer may comprise an array of plural ink jets, each with an orifice or nozzle outlet.

It is accordingly one object of the present invention to provide an ink jet print head which is capable of reliably and efficiently operating to provide grey scale or half-tone printing.

Another object of the present invention is to provide an improved ink jet print head which is capable of selectively producing ink drops of varying sizes.

These and other objects, features and advantages of the present invention will become apparent with reference to the following description and drawings.

DETAILED DESCRIPTION OF THE PREFERRED EMBODIMENTS

Figure 1:
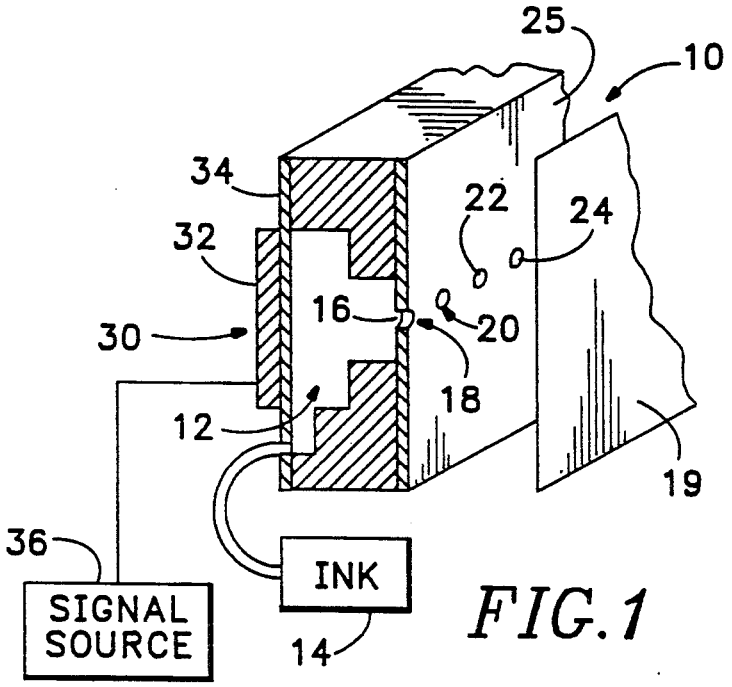
FIG. 1 is a schematic illustration, partially in section, of one form of ink jet print head in accordance with the present invention with print medium shown spaced from the ink jet print head.

With reference to FIG. 1, a drop-on-demand ink jet 10 is illustrated with an ink chamber 12 coupled to a source of ink 14. The ink jet 10 has an orifice 16 coupled to or in communication with the ink chamber 12. The orifice 16 has an outlet 18 through which ink passes during ink drop formation. The ink drops travel in a first direction along a path from the outlet toward print medium 19, which is spaced from the outlet 18. A typical ink jet printer includes a plurality of ink chambers each coupled to one or more respective orifices and orifice outlets. In FIG. 1, second, third and fourth orifices 20, 22 and 24 are shown extending through an orifice plate 25.

An acoustic drive mechanism 30 is utilized for generating a pressure wave in the ink to cause ink to pass outwardly through the ink drop orifice and outlet. The illustrated acoustic drive mechanism comprises piezoceramic material 32 bonded to a thin diaphragm 34 which overlies and closes one side of the ink chamber 12. The driver 30 bends in response to signals from a signal source 36 and causes pressure waves in the ink.

It should be noted that the invention has particular applicability and benefits when piezoelectric drivers are used in ink drop formation. One preferred form of an ink jet print head using this type of driver is described in detail in a patent application entitled "Drop-on-Demand Ink Jet Print Head", filed Nov. 1, 1989, Ser. No. 07/430,213 to Joy Roy and John Moore. This particular patent application is incorporated herein by reference and is owned by the Assignee of the present application. However, it is also possible to use other forms of ink jet printers and acoustic drivers in conjunction with the present invention. For example, electromagnet-solenoid drivers, as well as other shapes of piezoelectric drivers (e.g., circular, polygonal, cylindrical, annular-cylindrical, etc.) may be used. In addition, various modes of deflection of piezoelectric drivers may also be used, such as bending mode, shear mode, and longitudinal mode.

Although these other advantages exist, one of the principal advantages of the present invention relates to the effective achievement of half-tone or grey scale printing in a drop-on-demand ink jet printer. The phrase grey scale printing is synonymous with drop volume modulation or variation.

In general, the volume of ink contained in an individual ink drop is controlled by the diameter of the ink jet orifice and by controlling the wave form used in driving the acoustic driver. By adjusting the wave form to increase the volume of ink, larger ink drops can be achieved. Conversely, by adjusting the drive wave form to reduce the volume of ink, smaller ink drops result.

Figure 2:
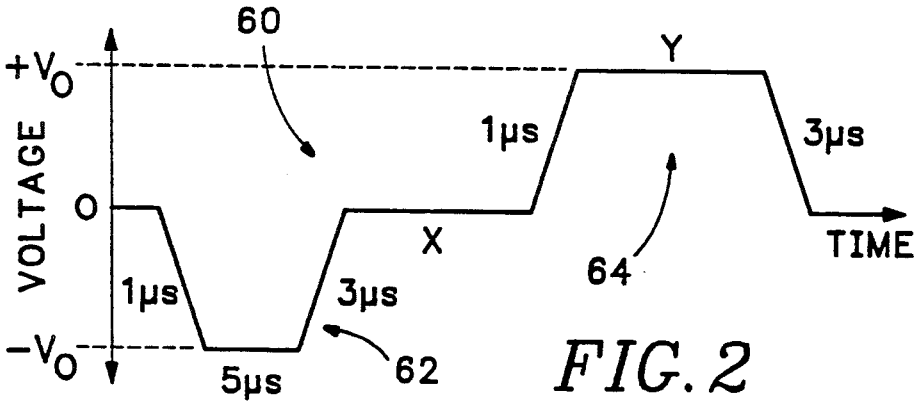
FIG. 2 illustrates a drive signal for an acoustic driver of an ink jet printer in accordance with the present invention.

In accordance with the present invention, an advantageous drive signal for achieving grey scale printing is illustrated in FIG. 2. This particular drive signal is a bipolar electric pulse 60 with a refill pulse component 62 and an ejection pulse component 64. The components 62 and 64 are of voltages of opposite polarity. The pulse components 62, 64 are also separated by a wait time period X. The polarities of the components 62, 64 may be reversed from that shown in FIG. 2 depending upon the polarization of the piezoelectric driver mechanism 30. In operation, upon the application of the refill pulse component 62, the ink chamber 12 expands and draws ink into the chamber for refilling the chamber following the ejection of a drop. As the voltage falls toward 0 at the end of the refill pulse, the ink chamber begins to contract and moves the ink meniscus forwardly in the orifice 16 toward the orifice outlet 18. Upon the application of the ejection pulse component 64, the ink chamber is rapidly constricted to cause the ejection of a drop of ink. In this approach for forming a drop the duration of the refill pulse component is less than the time required for the meniscus, which has been withdrawn further into the orifice 16 as a result of the refill pulse, to return to an initial position adjacent to the orifice outlet 18. The duration of the refill pulse component is less than one-half of the time period of the natural or resonance frequency of the meniscus. More preferably, this duration is less than about one-fifth of the time period of the meniscus' natural resonance frequency. The resonance frequency of an ink meniscus in as orifice of an ink jet can be easily calculated from the properties of the ink and dimensions of the ink orifice in known manner. As the duration of the wait period increases, the ink meniscus moves closer to the orifice outlet 18 at the time the ejection pulse component 64 is applied. Smaller drop volumes of ejected drops are obtained by establishing a wait period which is short enough such that the eject pulse component is applied at a time that the meniscus is moving forward within the orifice and prior to the time that the meniscus reaches the orifice outlet. Conversely, larger volumes of ejected drops are obtained by extending the duration of the wait period sufficiently to allow the ink to reach the orifice outlet before the eject pulse component is applied. At this later time, the orifice is completely filled with ink. The duration of the desired wait period and the eject pulse width for a given drop volume depends upon the characteristics of the particular ink jet being utilized and can be observed by monitoring the performance of the ink jet. In general, the wait period and eject pulse component period are less than about one-half of the time period of the natural or resonance frequency of the meniscus. Typical meniscus resonance time periods range from 50 microseconds to 160 microseconds, depending upon the ink jet configuration and the ink being used. In addition, by increasing the duration of the eject pulse component 64, or by increasing the amplitude of the eject pulse component, the volume of the ink drops can be increased.

As a specific example, assume that an ink jet print head of the type disclosed in the previously mentioned U.S. patent application Ser. No. 07/430,213 to Joy Roy and John Moore, is to be operated at a 4 kilohertz drop repetition rate. In this case, various levels or volumes of ink in individual ink drops would result from altering the drive wave form of FIG. 2. The spots or dots, if printed with hot melt ink on mylar print medium and before fusing, are expected to range in size from about 2.2 mils. to about 3.9 mils. If the ink is hot melt ink, following fusing of the ink spots on the print medium, by the application of pressure, this variation in spot size is even greater, for example, from about 2.6 mils to about 5.5 mils. To achieve the smallest dot size, for example, the wait period X would be set at 9 microseconds and the duration Y of the eject pulse component 64 would be set at 3 microseconds. To achieve a next level of dot size, for example, X would be set at 11 microseconds and Y would be set at 5 microseconds. To achieve a still higher or greater dot size level, for example, X would be set at 11 microseconds and Y would be set at 9 microseconds. To achieve a fourth level dot size, for example, X would be set at 12 microseconds and Y would be set at 11 microseconds. To achieve a level 5 dot size, for example, X would be set at 12 microseconds and Y would be set at 15 microseconds. Finally, to achieve the largest dot size, for example, X would be set at 12 microseconds and Y would be set at 20 microseconds. In each of these cases, the amplitude and pulse width of the refill pulse component would be, for example, respectively forty volts and five microseconds. Also, the amplitude of the eject pulse component would be, for example, forty volts. By adjusting these component values of the bipolar drive pulses, the ink drop volumes and ink dot sizes would be correspondingly adjusted. Similarly, by increasing the amplitude of the eject pulse component, either alone or in combination with an adjustment of the duration of the wait period and of the pulse width of the eject pulse component, variation in ink drop volume would also be achieved. As the amplitude of the eject pulse component 64 increases, the ratio of the amplitude of the eject pulse component to the refill pulse component would increase as would the volume of ink included in the drops. Similarly, as the pulse width of the eject pulse component increases, the ratio of the pulse width of the eject pulse component to the pulse width of the refill pulse component would also increase, as would the ink drop volume.

In addition, plural bipolar pulses of the type shown in FIG. 2 may be utilized to produce an individual ink drop. In general, by increasing the number of such bipolar pulses used in forming an ink drop, the volume of ink in the ink drop is increased. In effect, each bipolar pulse causes an additional amount of ink to be added to the ink drop and thus increases the volume of ink included in an ink drop before the ink drop separates from the orifice outlet. To cause separation of an individual ink drop formed in this manner, the time period between the bipolar pulses is increased. Alternatively, it is also expected that drop break off can also be accomplished by applying a pulse of higher energy after the desired number of bipolar pulses have been used to generate the drop of the desired size.

As a specific example, a typical bipolar pulse of a string of such pulses, including the refill component, wait period component and eject component, may have a duration of from about 20 microseconds to 40 microseconds. In addition, the typical time delay between individual bipolar pulses may range from about 30 to about 100 microseconds. For an ink jet print head of the type shown in FIG. 1, if the time delay between individual pulses becomes greater than about 100 microseconds, the drops break off. Assuming a 20 microsecond duration bipolar pulse, then one exemplary separation between the bipolar pulses is about 40 microseconds. In this case the separation is about two times the duration of an individual bipolar pulse. If the time period between bipolar pulses is less than about 100 microseconds, or such other time at which drop break-off occurs, a successive bipolar pulse would add ink to the volume of an individual ink drop instead of generating a separate drop.

The compounding of one or more bipolar pulses to produce an individual drop does reduce the maximum drop repetition rate at which an ink jet printer can be operated. However, high drop repetition rates are still possible. For example, assuming the case above where up to three bipolar pulses are combined to produce the largest drop sizes, repetition rate of up to eight kilohertz have been achieved.

Figure 3:
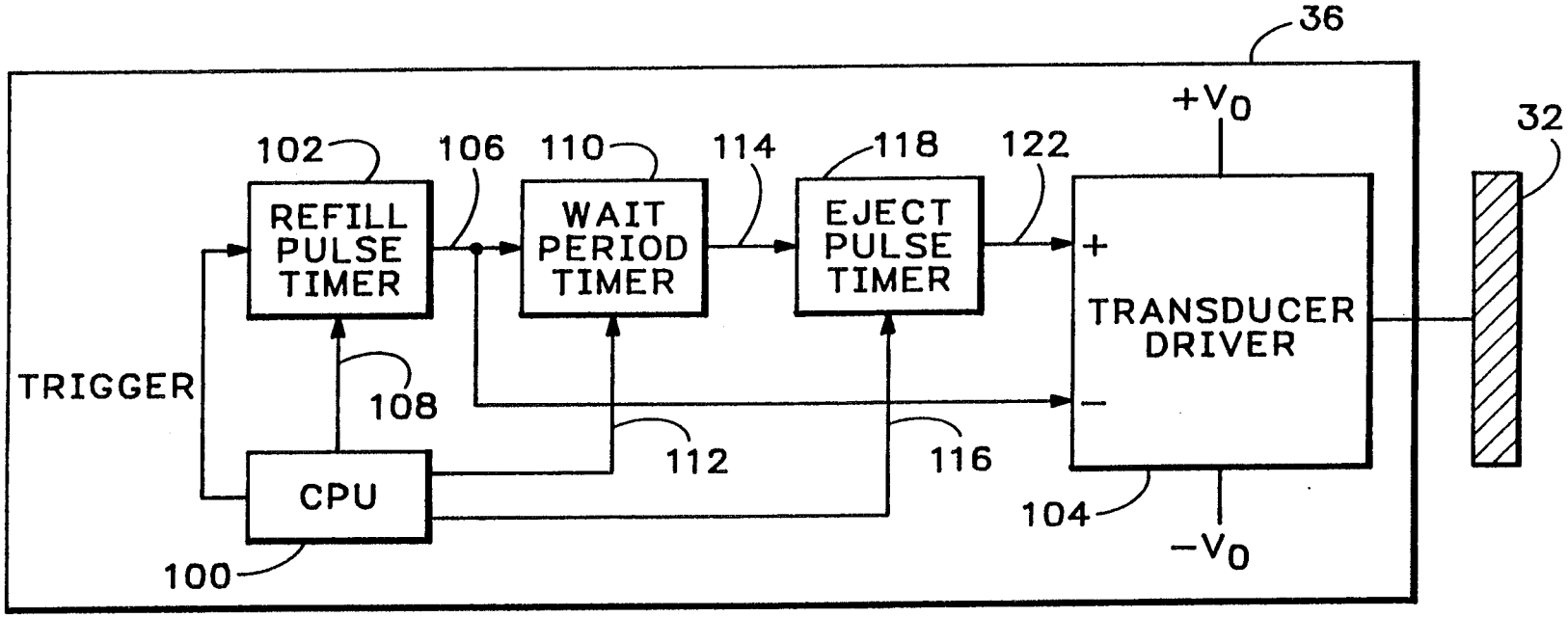
FIG. 3 illustrates an example of a circuit for the signal source.

FIG. 3 illustrates an example of circuitry inside signal source 36 that can be used to produce bipolar electric pulse 60, which is applied to piezoceramic material 32. Referring to FIG. 3, CPU 100 outputs a trigger pulse to refill pulse timer 102 to initiate pulse component 62. In response to the trigger pulse, refill pulse timer 102 outputs a refill pulse drive signal at output 106 to the negative input of transducer driver 104, causing transducer driver 140 to output component 62 in FIG. 2. The duration of component 62 is controlled by a count that is loaded form CPU 100 through counter preset line 108.

When refill pulse timer 102 counts to zero, the signal at output 106 goes to a zero value which (1) causes the negative input of transducer drive 104 to return to a zero value and (2) initiates wait period timer 110. As the input of transducer driver 104 returns to zero, component 62 ends and the wait period begins. The wait period has a duration X which is controlled by a count that is loaded from CPU 100 through counter preset line 112.

When wait period timer 110 counts to zero, the signal at output 114 goes to a zero value which initiates eject pulse timer 118. The output of eject pulse timer 118 at output 122 causes the positive input of transducer driver 104 to go high and component 64 in FIG. 2 to begin. Component 64 has a duration Y which is controlled by a count that is loaded from CPU 100 through counter preset line 116. When eject pulse timer 118 counts to zero, the signal at output 122 goes to a zero value ending component 64.

Finally, it should be noted that the present invention is applicable to ink jet printers using a wide variety of inks. Inks that are liquid at room temperature, as well as inks of the phase change type which are solid at room temperature, may be used. One suitable phase change ink is disclosed in U.S. patent application Ser. No. 227,846, filed Aug. 3, 1988 now U.S. Pat. No. 4,889,560, and entitled "Phase Change Ink Carrier Composition and Phase Ink Produced Therefrom". Again, however, the present invention is not limited to particular types of ink.

Having illustrated and described the principles of out invention with reference to several preferred embodiments, it will be apparent to those of ordinary skill in the art that the invention may be modified in an arrangement in detail without departing from such principles. We claim as our invention all such modification which fall within the scope of the following claims.

We claim:

1. A method of operating a drop-on-demand ink jet of the type having an ink chamber coupled to a source of ink and to an ink drop orifice with an outlet, and acoustic drive means for producing a pressure wave in the ink in response to a drive signal to cause a portion of the ink to pass outwardly through the ink drop orifice and outlet, the ink having a meniscus with a resonance frequency having a time period, and in which ink drops each having a volume of ink travel along a path from the outlet toward a print medium spaced from the outlet, the method comprising:

applying to the acoustic drive means at least one drive signal comprising at least one bipolar electric pulse with refill and ejection pulse components of voltages of opposite relative polarity which are separated by a wait period having a duration, the ejection pulse component having an amplitude and a duration and following the wait period and the refill pulse component, the refill pulse component having a fixed amplitude and a fixed duration which is less than about one-fifth of the time period of the resonance frequency of the meniscus; and varying a parameter of the drive signal to vary the volume of ink in the ink drops.

2. A method according to claim 1 in which the parameter is the duration of the wait period.

3. A method according to claim 1 in which the parameter is the duration of the ejection pulse component.

4. A method according to claim 1 in which the parameter is the duration of the ejection pulse component and further comprising the step of varying the duration of the wait period to vary the volume of the ink in the ink drops:

5. A method according to claim 1 in which the ink is phase charge ink.

6. A method according to claim 1 in which the refill pulse component is of a duration which is less than one-fifth of the time period of the natural resonance frequency of the ink meniscus.

7. A method of operating a drop-on-demand ink jet of the type having an ink chamber coupled to a source of ink and to an ink drop orifice with an outlet, the acoustic drive means for producing a pressure wave in the ink in response to a drive signal to cause a portion of the ink to pass outwardly through the ink drop orifice and outlet, the ink having a meniscus with a resonance frequency having a time period, and in which ink drops each having a volume of ink travel along a path from the outlet toward a print medium spaced from the outlet, the method comprising:

applying to the acoustic drive means at least one bipolar electric pulse having refill and ejection pulse components of voltages of opposite relative polarity which are separated by a wait period, the refill pulse component having a fixed amplitude and a fixed duration which is less than about one-fifth of the time period of the resonance frequency of the meniscus; and varying the number of bipolar pulses to form the ink drops to vary the volume of ink in the ink drops.

8. A drop-on-demand ink jet head assembly for applying an ink drop having a volume to a print medium spaced from the ink jet head assembly, the ink having a meniscus with a resonance frequency having a time period, the ink jet head assembly comprising:

chamber means for containing ink, the chamber means being coupled to an ink drop orifice having an outlet;

a drive signal circuit that produces a drive signal that includes a bipolar electric pulse with refill and ejection pulse components of voltages of opposite relative polarity which are separated by a wait period, the ejection pulse component having an amplitude and a duration and the wait period having a duration, the ejection pulse component following the wait period and the refill pulse component, the refill pulse component having a fixed amplitude and a fixed duration which is less than about one-fifth of the time period of the resonance frequency of the meniscus; and acoustic drive means receiving the drive signal for producing a pressure wave in the ink in response to the drive signal to cause a portion of the ink to pass outwardly through the ink drop orifice and outlet and form the ink drop, the ink drop traveling from the outlet toward the print medium, the volume of the ink drop being responsive to a parameter of the drive signal.

9. The ink jet head assembly of claim 8 in which the parameter is the duration of the wait period.

10. The ink jet head assembly of claim 8 in which the parameter is the duration of the ejection pulse component.

11. The ink jet head assembly of claim 8 in which the parameter is the duration of the ejection pulse component and in which the volume of the ink drop is responsive to the duration of the wait period.

12. A drop-on-demand ink jet head assembly for applying an ink drop having a volume to a print medium spaced from the ink jet head assembly, the ink having a meniscus with a resonance frequency having a time period, the ink jet head assembly comprising:

chamber means for containing ink, the chamber means being coupled to an ink drop orifice having an outlet;

a drive signal circuit that produces a drive signal that includes a bipolar electric pulse with refill and ejection pulse components of voltages of opposite relative polarity which are separated by a wait period, the ejection pulse having a duration and an amplitude and the wait period having a duration, the ejection pulse component following the wait period and the refill pulse component, the refill pulse component having a fixed amplitude and a fixed duration which is less than about one-fifth of the time period of the resonance frequency of the meniscus; and acoustic drive means receiving the drive signal for producing a pressure wave in the ink in response to the drive signal to cause a portion of the ink to pass outwardly through the ink drop orifice and outlet and form the ink drop, the ink drop traveling from the outlet toward the print medium after at least one of the bipolar electric pulses has been received, the volume of the ink drop being responsive to the number of bipolar electric pulses received by the drive means.

13. The ink jet head assembly of claim 12 in which the bipolar electric pulses are separated from each other by a time period which is insufficient to cause the breaking off of a drop at the orifice outlet until a selected number of the bipolar drive pulses have been applied.

14. The ink jet head assembly of claim 12 in which the bipolar electric pulses are separated from each other by no more than about one hundred microseconds.

15. The ink jet head assembly of claim 12 in which the bipolar electric pulses are separated from one another by a time period of at least about two times the duration of an individual bipolar electric pulse.

16. The ink jet head assembly of claim 12 in which the bipolar electric pulses are separated from one another by a time period of from about thirty to about one hundred microseconds.

* * * * *

UNITED STATES PATENT AND TRADEMARK OFFICE

CERTIFICATE OF CORRECTION

PATENT NO. : 5,124,716

DATED : June 23, 1992

INVENTOR(S) : Joy Roy, Susan C. Schoening

It is certified that error appears in the above-identified patent and that said Letters Patent is hereby corrected as shown below:

Col. 8, line 25, "the" should be "and".

Signed and Sealed this

Seventeenth Day of August, 1993

Bruce Lehman

*Attest:*

BRUCE LEHMAN

*Attesting Officer*

*Commissioner of Patents and Trademarks*